US006591651B2

(12) United States Patent
Kutschker et al.

(10) Patent No.: US 6,591,651 B2
(45) Date of Patent: Jul. 15, 2003

(54) SHEET METAL FORMING MACHINE

(75) Inventors: Wolfgang Kutschker, Boeblingen (DE); Franz Jaeger, Esslingen (DE)

(73) Assignee: Reinhardt Maschinenbau GmbH, Sindelfingen (DE)

( * ) Notice: Subject to any disclaimer, the term of this patent is extended or adjusted under 35 U.S.C. 154(b) by 0 days.

(21) Appl. No.: 09/996,031

(22) Filed: Nov. 19, 2001

(65) Prior Publication Data

US 2002/0083750 A1 Jul. 4, 2002

Related U.S. Application Data

(63) Continuation of application No. PCT/EP01/02595, filed on Mar. 8, 2001.

(30) Foreign Application Priority Data

Mar. 20, 2000 (DE) ..... 100 13 801

(51) Int. Cl.[7] ..... B21B 1/10

(52) U.S. Cl. ..... 72/101; 72/10.1; 72/13.4; 72/20.1; 72/105

(58) Field of Search ..... 72/10.1, 13.4, 72/13.5, 20.1, 20.2, 101, 105, 106, 121

(56) References Cited

U.S. PATENT DOCUMENTS

| | | | | | |
|---|---|---|---|---|---|
| 3,610,010 | A | * | 10/1971 | Henz et al. | 72/85 |
| 4,445,352 | A | * | 5/1984 | Pols | 72/101 |
| 4,575,289 | A | * | 3/1986 | Fischer et al. | 72/101 |
| 4,869,088 | A | * | 9/1989 | Kadotani | 72/105 |
| 5,056,345 | A | * | 10/1991 | Nonini | 72/244 |
| 5,187,959 | A | * | 2/1993 | Davi | 72/20.1 |
| 6,240,761 | B1 | * | 6/2001 | Suzuki | 72/106 |

FOREIGN PATENT DOCUMENTS

| | | |
|---|---|---|
| DE | 843 536 | 7/1952 |
| DE | 1 089 714 | 9/1960 |
| DE | 39 36 200 | 12/1990 |

* cited by examiner

*Primary Examiner*—Ed Tolan
(74) *Attorney, Agent, or Firm*—Barry R. Lipsitz; Douglas M. McAllister

(57) ABSTRACT

In order to improve a sheet metal forming machine comprising a machine frame, a first roller tool mounted on the machine frame for rotation about a first roller axis, a second roller tool which is rotatable about a second roller axis, interacts with the first roller tool and is mounted for rotation in a feed bearing which, for its part, can be moved and fixed in position in relation to the machine frame transversely to the first roller axis by means of a feed drive so that a feed position of the second roller tool relative to the first roller tool can be adjusted and a roller drive for at least one of the roller axes, in such a manner that this can be operated as simply as possible it is suggested that the feed drive be designed as a feed drive which can be controlled as to its position by a control and by means of which the second roller tool can be moved into feed positions predeterminable in a defined manner, that the roller drive be designed as a controllable roller drive and that roller axis positions of the roller axes be recordable and roller axis positions and feed positions linkable to one another by the control.

16 Claims, 5 Drawing Sheets

| R | Z | BR |
|---|---|---|
| R0 | Z0 | BR0 |
| R0 | Z1 | BR0 |
| R1 | Z2 | BR0 |
| R2 | Z2 | BR0 |
| R3 | Z3 | BR0 |
| R4 | Z3 | BR0 |
| R5 | Z4 | BR1 |
| R6 | Z4 | BR1 |
| R7 | Z5 | BR0 |
| R8 | Z5 | BR0 |
| R8 | Z0 | BR0 |
| | | |

feed position Z
15
10
5
0
Z0
Z0
Z1
Z2
Z3
Z4
Z5
time
roller axis position R
2000
1000
0
t1
R0
R1
R2
R3
R4
R5
R6
R7
R8
time

SHEET METAL FORMING MACHINE

The present disclosure is a continuation of the subject matter disclosed in International Application No. PCT/EP01/02595 (WO 01/70427) of Mar. 8, 2001, which is incorporated herein by reference in its entirety and for all purposes.

BACKGROUND OF THE INVENTION

The invention relates to a sheet metal forming machine, comprising a machine frame, a first roller tool mounted on the machine frame for rotation about a first roller axis, a second roller tool which is rotatable about a second roller axis and interacts with the first roller tool and which is mounted for rotation in a feed bearing which, for its part, can be moved and fixed in position in relation to the machine frame transversely to the first roller axis by means of a feed drive so that a feed position of the second roller tool relative to the first roller tool can be adjusted, and a roller drive for at least one of the roller axes.

Sheet metal forming machines of this type are known from the state of the art; in these cases, a manual actuation of the feed drive and a manual adjustment of the roller drive are, for example, provided.

An object underlying the invention is therefore to improve a sheet metal forming machine of the generic type in such a manner that this can be operated as simply as possible.

A further object underlying the invention is therefore to improve a sheet metal forming machine in such a manner that the top end section can be designed more advantageously and more simply from a constructional point of view.

SUMMARY OF THE INVENTION

This object is accomplished in accordance with the invention, in a sheet metal forming machine of the type described at the outset, in that the feed drive is designed as a feed drive which can be controlled as to its position by a control and by means of which the second roller tool can be moved into feed positions which are predeterminable in a defined manner, that the roller drive is designed as a controllable roller drive and that roller axis positions of the roller axes can be recorded and roller axis positions and feed positions linked to one another by the control.

The advantage of the inventive solution is to be seen in the fact that with it a simplified operation of the sheet metal forming machine is possible since the advancing of the second roller tool towards the first roller tool can be brought about by the control due to the linking of feed positions and roller axis positions.

In this respect, the linking of roller axis positions and feed positions can be brought about, in principle, in any optional manner, for example, in the manner such as that known for numerically controlled machines.

A particularly advantageous and simple solution for the operation of such a sheet metal forming machine provides for the control to allocate feed positions to the roller axis positions and store these in a memory as sets of data.

Such an allocation of feed positions to roller axis positions makes it possible in a simple manner, when approaching the individual roller axis positions, to have the feed positions associated with them approached in a manner automatically controlled by the control.

With respect to the design of the memory, it is particularly advantageous when the memory stores sets of data for at least one forming cycle of a workpiece.

It is, however, also conceivable to design the memory such that this is in a position to store several different forming cycles for different workpieces and creates the possibility of calling up the forming cycle suitable for the respective workpiece to be formed.

With respect to the manner in which the sets of data are recorded by the control, the most varied of possibilities are conceivable. It is, for example, conceivable to specify the sets of data to the control via numerical data and have these stored in the memory by the control.

Another possibility is to determine the sets of data via a computer simulation and have these stored in the memory by the control.

A particularly favorable and, above all, simple solution for the user of the sheet metal forming machine provides for the control to record an allocation of feed positions to roller axis positions in a learning mode.

In such a learning mode, actual roller axis positions and feed positions could, for example, be specifiable to the control and then be recordable as a result by the control in the learning mode.

A particularly convenient and, in particular, user-friendly solution provides for the sets of data to be recordable by the control during the course of a manually controlled forming cycle actually carried out on a workpiece with the sheet metal forming machine.

This solution has the advantage that the user of the sheet metal forming machine can form a first workpiece conventionally by way of manual adjustment of the roller axis positions and the feed positions and, at the same time, can store the association of feed positions and roller axis positions during the forming of the workpiece via the learning mode so that during subsequent formings of workpieces of the same type the forming can then be carried out in a controlled a manner by the control.

A particularly advantageous solution provides for a controlled forming of a workpiece to be carried out with the control in a forming mode, during which the control, by reading the stored data, automatically realizes the stored allocation of the feed positions to the roller axis positions by activating the feed drive.

With respect to the specification of the roller axis movement, the most varied of possibilities are conceivable. It would, for example, be conceivable in a convenient solution to also have the roller axis movement carried out in a manner automatically controlled by the control, wherein, in this case, data concerning the course of the roller axis movement during the forming cycle must also be specified to the control.

It has, however, proven to be particularly expedient, in particular, with respect to a simple operability of the sheet metal forming machine, when the maximum speed of the roller axis movement in the forming mode can be predetermined manually during the forming.

This means that the user of the sheet metal forming machine always has the possibility of stopping it, for example, when he recognizes problems during the machining of the workpiece.

Furthermore, the user can predetermine the maximum speed in a simple manner, observe the machining of the workpiece and can thus always control the forming process visually while the control automatically allocates the feed positions to the individual roller axis positions.

In order to exclude, during the manual specification of the maximum speed, unsuitable forming processes which can, for example, result due to the fact that the specified maximum speed of the roller axis movement impairs the precision of the forming, it is provided for the control to have a speed limiting mode, in which with the control in the forming mode the maximum possible speed of the roller axis movement can be adjusted so as to deviate from the manually predeterminable speed of the roller axis movement.

This means that in the speed limiting mode the control can automatically and actively influence the roller axis movement and reduce the speed of the roller axis movement.

The transfer into such a speed limiting mode can, for example, always take place when a feed movement is intended to be brought about by the feed drive.

A particularly advantageous form of realization of such a speed limiting mode provides for the control to adapt the maximum possible speed of the roller axis movement to the maximum possible speed of the feed movement such that the association of feed position and roller axis position is maintained.

In conjunction with the preceding explanations concerning the individual embodiments of the inventive sheet metal forming machine, it has not been specified in greater detail to what extent information exceeding the allocation of feed positions to roller axis positions is stored by the control. It has, in this respect, proven to be particularly advantageous when information concerning the roller axis movement can be stored with the control.

In this respect, it is particularly favorable when the information concerning the roller axis movement is allocated to the roller axis positions.

The allocation could, for example, be brought about by means of separate sets of data, with which the information concerning the roller axis movement is allocated to the roller axis positions.

A particularly favorable solution does, however, provide for the information concerning roller axis movements to be co-recorded in the sets of data comprising the roller axis positions and the feed positions.

With respect to the information to be recorded concerning the roller axis movement, the most varied of possibilities are conceivable. It is particularly advantageous when at least information concerning the direction of movement of the roller axis movement is stored as information concerning the roller axis movements.

It is, however, also conceivable to store speed information or acceleration information as information concerning the roller axis movement.

During the storing of information concerning the roller axis movement it is likewise advantageous when the control transfers into the speed limiting mode when a change in the direction of movement of the roller axis movement is intended to take place.

A particularly favorable embodiment provides for the control, in the speed limiting mode, to reduce the speed of the roller axis movement to zero in accordance with a predetermined course during a change in the direction of movement of the roller axis movement and subsequently to increase it again in the reverse direction in accordance with a predetermined course.

In order for the control to be in a position to be able to carry out the necessary activations as promptly as possible, it is provided in a particularly favorable solution for the control to record the information associated with future roller axis positions proceeding from the current roller axis position.

The control operates particularly expediently when it transfers into the speed limiting mode on account of information associated with future roller axis positions and thus already adapts the speed of the roller axis movement, so-to-speak "in advance", in accordance with the adjustments to be carried out in the future.

With respect to the design of the sheet metal forming machine, no further details have been given in conjunction with the preceding explanations concerning the individual embodiments. One particularly advantageous embodiment of the inventive sheet metal forming machine provides, for example, for the machine frame to have a column with a top end section arranged on it, for the first roller tool to be mounted in the top end section so as to be rotatable about the first roller axis and for the feed bearing for the second roller tool to be arranged in the top end section.

Such a sheet metal forming machine is preferably designed as a so-called seam-rolling machine.

With a seam-rolling machine of this type, the feed drive is normally arranged on a projection of the top end section and so the projection of the top end section has to be sufficiently stable in order to, in particular, bear the feed drive and absorb the necessary forces.

In accordance with the further object of the invention, in a sheet metal forming machine comprising a machine frame, a first roller tool mounted on the machine frame for rotation about a first roller axis, a second roller tool which is rotatable about a second roller axis and interacts with the first roller tool and which is mounted for rotation in a feed bearing which, for its part, can be moved and fixed in position in relation to the machine frame transversely to the first roller axis by means of a feed drive so that a feed position of the second roller tool relative to the first roller tool can be adjusted, and a roller drive for at least one of the roller axes, in that the machine frame has a column with a top end section arranged on it, that the first roller tool is mounted in the top end section as so to be rotatable about the first roller axis and the feed bearing for the second roller tool is arranged in the top end section, that the feed bearing is mounted on an end area facing the roller tools of an arm extending in the top end section and that the feed drive is arranged on the machine frame outside a projection of the top end section and acts on the arm.

It is possible with this solution for the projection of the top end section to no longer need to bear the feed drive and thus lesser requirements as to stability need to be met by it.

Moreover, the arm for the movement of the feed bearing also creates the possibility of absorbing the forces necessary for the advancing of the feed bearing essentially outside the projection of the top end section via the machine frame.

A particularly favorable solution provides, in this respect, for the arm to be part of a lever gearing which can be driven by the feed drive and creates a particularly favorable possibility from a constructional point of view of transferring the forces acting on the feed bearing to the machine frame outside the projection.

In this respect, it is particularly favorable when the lever gearing is mounted on the machine frame via a bearing axle which is arranged at a distance from the roller tools.

In this respect, it is particularly favorable when the bearing axle is arranged outside the projection of the top end section.

In this respect, it is particularly favorable when the bearing axle is arranged in an area of the machine frame facing away from the roller tools.

A particularly favorable arrangement of the bearing axle provides for this to be arranged in the base of the top end section so that the pulling forces transferred to the machine frame from the bearing axle act in an area of the top end section supported by the column, namely the base, and thus a simple stabilization of the mounting of the bearing axle relative to the column is possible.

A particularly favorable design of the lever gearing provides for this to comprise a second arm, on which the feed drive acts.

The second arm of the lever gearing can, in principle, extend in any optional direction. In order to obtain as compact a type of construction as possible of the inventive sheet metal forming machine, it is preferably provided for the second arm to extend in the direction of the column.

This type of design of the lever gearing creates the possibility of locating the actuation of the lever gearing in the area of the column and thus in an area of the sheet metal forming machine which can easily be provided with great stability.

A particularly favorable design of the inventive sheet metal forming machine provides for the feed drive to act on the arm via a reduction gear. This solution has the advantage that sufficiently large forces for the movement of the feed bearing can already be generated with a low driving power and so it is possible, in particular, to use an electric motor.

The reduction gear can be designed in the most varied of ways. One possibility would be to design the reduction gear as a conventional toothed-wheel gearing. It is, however, particularly favorable, especially in order to apply large forces, when the reduction gear comprises a wedge gear.

Such a wedge gear can, for example, be a spindle gearing or an eccentric gear. A particularly favorable solution provides, however, for the wedge gear to be a cam gear.

Such a cam gear may be realized with particularly simple means from a constructional point of view when the cam gear has a cam disk which acts on a cam follower arranged on the lever gearing.

In this respect, the cam gear is preferably designed such that the cam disk acts on the cam follower in the sense of advancing the second roller tool towards the first roller tool so that the cam gear can generate the large force required for advancing the second roller tool towards the first roller tool.

In order, in addition, to have the possibility of being able to move the second roller tool away from the first roller tool, it is preferably provided for the lever gearing to have an elastic biasing means which acts on the first arm in the sense of a movement of the second roller tool in relation to the first roller tool in the opposite direction to the direction of feed.

The lever gearing can, in principle, be optionally complex, wherein the first arm is arranged on the one hand and the second arm on the other hand. A particularly simple, constructional solution provides for the lever gearing to comprise an angle lever which forms the first arm and the second arm and extends with the first arm in the top end section and with the second arm in the column.

Additional features and advantages of the invention are the subject matter of the following description as well as the drawings illustrating one embodiment.

DETAILED DESCRIPTION OF THE INVENTION

Figure 1:
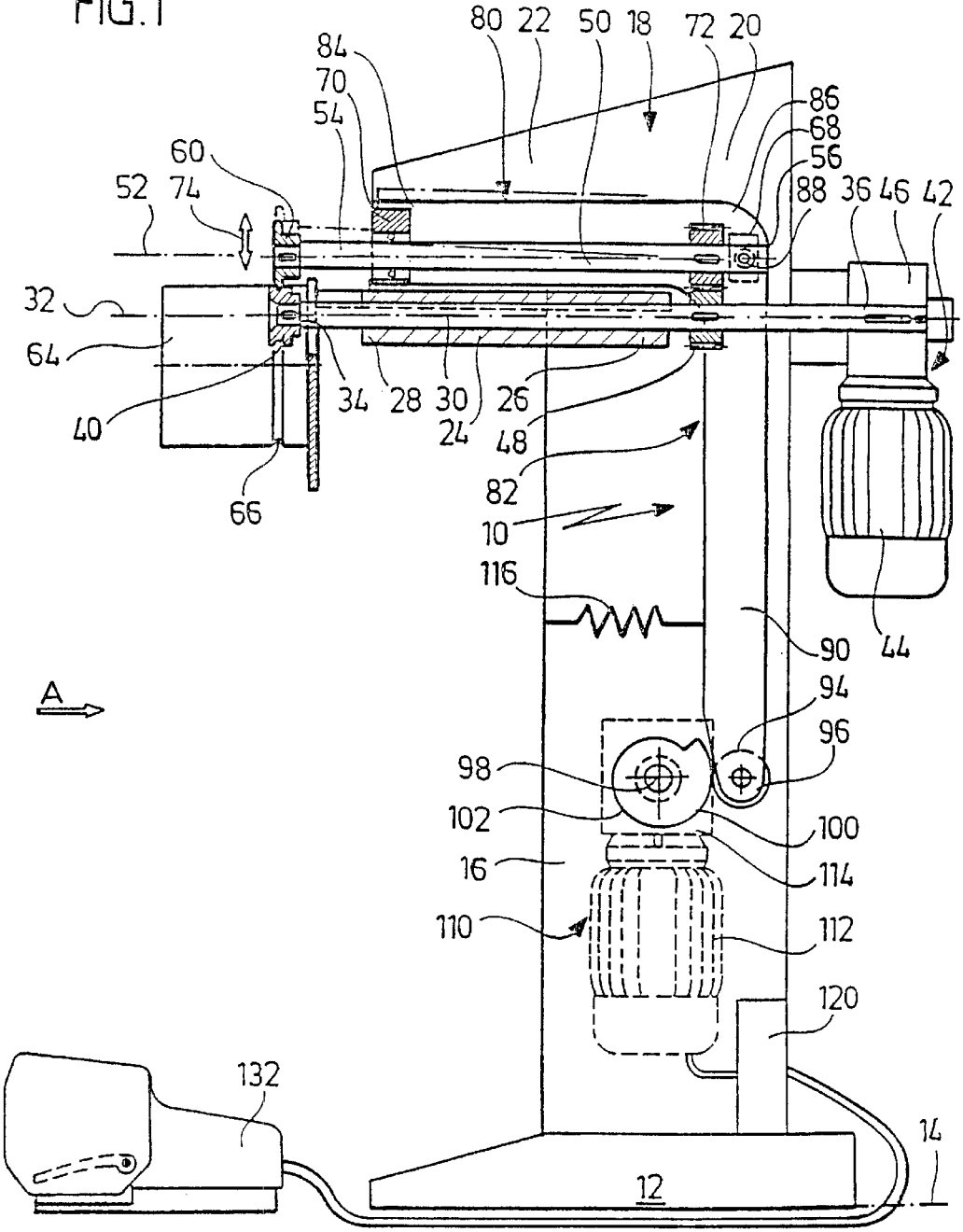
FIG. 1 shows a vertical section through an inventive sheet metal forming machine.
Figure 2:
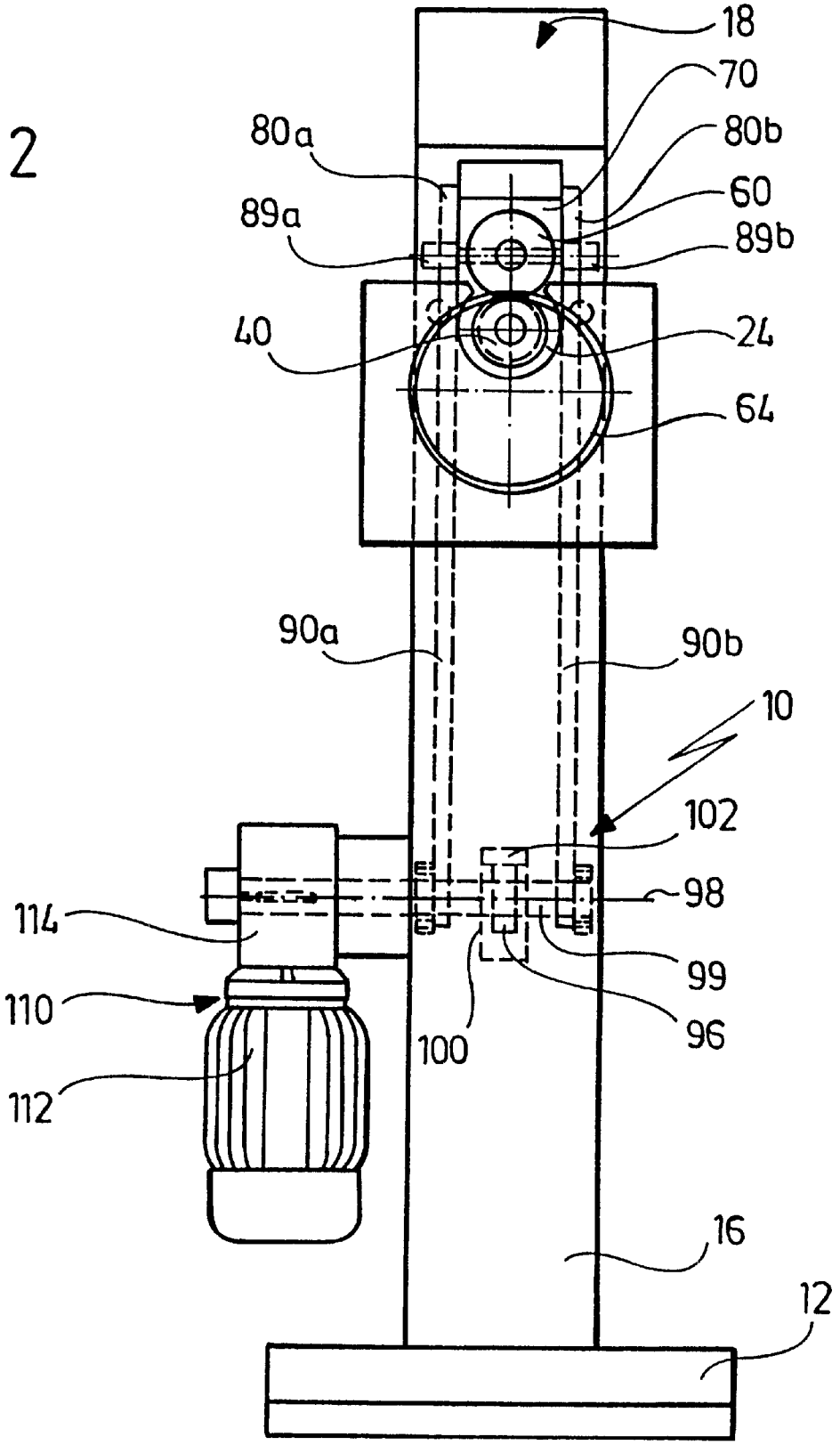
FIG. 2 shows a side view in the direction of arrow A in FIG. 1.

One embodiment of a sheet metal forming machine, for example, a seam-rolling machine illustrated in FIG. 1 comprises a machine frame which is designated as a whole as 10, stands with a foot 12 on a base surface 14 and has a column 16 which rises above the foot 12 and extends as far as a top end section designated as a whole as 18. The top end section 18 is securely connected to the column 16 and has a projection 22 extending laterally beyond the column 16 proceeding from its base 20 arranged above the column 16.

A bearing sleeve 24 securely connected to the column 16 is provided in the projection 22 of the top end 18, is anchored with an end area 26 in the column 16 and ends with the oppositely located end area 28 at a distance from the column 16. The bearing sleeve 24 serves to mount a first tool shaft 30 which extends transversely to the column 16, preferably approximately horizontally, and is rotatable about a first roller axis 32. The first tool shaft 30 thereby projects beyond the end 28 of the bearing sleeve 24 with a front end 34 and bears thereon a first roller tool 40 which is non-rotatably connected to the first tool shaft 30.

Furthermore, the first tool shaft 30 extends through the bearing sleeve 24 and thus also through the projection 22 and the base 20 of the top end section 18 and beyond the column 16 and the top end section 18 on a side located opposite the projection 22 as far as a rearward end 36 which can be driven by a drive designated as a whole as 42, preferably an electric drive motor 44 with a reduction gear 46.

Furthermore, the first tool shaft 30 bears an intermediate pinion 48 which is arranged between the bearing sleeve 24 and the rearward end 36 in the area of the base 20 of the top end section 18 and with which a second tool shaft 50 can be driven which is located on a side of the first tool shaft 30 located opposite the column 16 and is rotatable about a second roller axis 52.

The second tool shaft 50 likewise extends beyond the projection 22 of the top end section 18 and bears at its front end 54 a second roller tool 60 which interacts with the first roller tool 40 in the sense of a rolling sheet metal machining of a workpiece 64 in order to, for example, provide the workpiece 64 with a bead 66.

The second tool shaft 50 extends, in addition, into the top end section 18 and thereby through the projection 22 as far as the base 20 and ends in the area of the base 20 with a rearward end 56.

The rotatable mounting of the second tool shaft 50 is brought about, on the one hand, by a rear-side pivot bearing 68, which is arranged in the area of the rearward end 56 and mounted so as to be pivotable in relation to the machine frame 10, as well as a feed bearing 70 which is arranged near to the front end 54 and is located at a distance from the second roller tool 60, preferably approximately over the end area 28 of the bearing sleeve 24.

Furthermore, an intermediate pinion 72, which is arranged near to the rear-side pivot bearing 68, preferably directly adjacent to it, and is in direct engagement with the intermediate pinion 48, is provided for driving the second tool shaft 50.

As a result, the first tool shaft 30 is driven, first of all, by the drive 42 and the second tool shaft 50 via the intermediate pinions 48 and 72 by a drive derived from the first tool shaft 30.

With the inventive sheet metal forming machine, the second roller tool 60 can now be moved transversely to the first roller axis 32 in a direction 74, preferably approximately vertically parallel to a plane extending through the first roller axis 32, in order to be able to advance the second roller tool 60 relative to the first roller tool 40 for the machining of the workpiece in a defined manner, i.e. in order to be able to position the second roller tool 60 in defined feed positions relative to the first roller tool 40.

In order to achieve this, a first arm 80 of a lever gearing designated as 82 is provided and extends in the top end section 18, bears at a front end 84 the feed bearing 70 arranged in the projection 22 of the top end section 18 and extends through the projection 22 as far as the base 20 of the top end section 18 proceeding from its front end 84. The rear-side pivot bearing 68 for the second tool shaft 50 which is arranged in the area of a rear end 86 is either mounted on the machine frame 10 so as to be independently pivotable or is held on the rear end 86 and pivotable with the arm 80. Furthermore, the first arm 80 is, in the area of the rear end 86, mounted on the machine frame 10 by means of bearing pins 89 in the area of the base 20 of the top end section 18 so as to be pivotable about a pivot axis 88.

In this respect, the pivot axis 88 is preferably located near to the rear-side pivot bearing 68 and the intermediate pinion 72, preferably directly adjacent to them or passes through them so that the pivoting movement of the first arm 80 about the pivot axis 88 for reaching different feed positions of the second roller tool 60 is brought about such that the intermediate pinion 72 always remains in engagement with the intermediate pinion 48 and thus the rotary movement of the second tool shaft 50 always remains coupled to the rotary movement of the first tool shaft 30.

The lever gearing 82 further comprises a second arm 90 which is rigidly connected to the first arm 80, extends in the direction of the foot section 12 proceeding from the rear end 86 of the first arm and is preferably arranged within the column 16 and bears at its end 94 located so as to face away from the pivot axis 88 a cam follower 96 in the form of a roller mounted for rotation on an axle 99.

The cam follower 96 thereby abuts on a cam disk 100 which is mounted so as to be rotatable in relation to the column 16 about an axis of rotation 98 which is arranged so as to be stationary relative to the column 16, the cam disk bearing a path cam 102, which extends spirally in relation to the axis of rotation 98 and is located radially outwards in relation to the axis of rotation 98, so that the cam follower 96 can be positioned at different distances to the axis of rotation 98 in accordance with the rotary position of the cam disk 100.

The cam disk 100 can be driven by a feed drive which is designated as a whole as 110 and preferably has an electric motor 112 and a gear 114.

Furthermore, the second arm 90 is constantly acted upon by an elastic force by means of an elastic biasing means 116, which engages, on the one hand, on the column 16 and, on the other hand, on the second arm 90, such that the cam follower 96 abuts on the path cam 102.

If the cam disk 100 is now turned by the feed drive 110, the distance of the cam follower 96 from the axis of rotation 98 can be varied and thus the second arm 90 can be pivoted in relation to the machine frame 10 on account of its pivotability about the pivot axis 88, which results in the simultaneous pivotability of the first arm 80 likewise in relation to the machine frame 10, in particular, relative to the top end section 18.

As a result of the arrangement of the feed bearing 70 on the front end 84 of the first arm 80, any movement of the cam follower 96 leads at the same time to a movement of the feed bearing 70 transversely to the first roller axis 32 and thus to a movement of the second roller tool 60 in a direction 74.

The cam follower 96 is arranged relative to the cam disk 100 such that any increase in the distance of the cam follower 96 from the axis of rotation 98 leads to an advancing of the feed bearing 70 in the direction towards the first roller axis 32, i.e. to an advancing of the second roller tool 60 in the direction towards the first roller tool 40. This means that the counterforces acting on the roller tools 40 and 60 from the lever gearing 82 are transferred such that these lead to the cam follower 96 acting on the path cam 102 with pressure such that the elastic biasing means 116, for example, in the form of a spring acts on the lever gearing 82 such that with it the second roller tool 60 can be moved away from the first roller tool 40 to the extent allowed by the position of the cam disk 100.

The first arm 80 and the second arm 90 of the lever gearing 82 are each preferably formed from two side wall parts 80*a* and 80*b* and 90*a* and 90*b*, respectively, between which the feed bearing 70 and the rear-side pivot bearing 68 of the second tool shaft 50 are located and which are each, for their part, mounted via the bearing pins 89*a* and 89*b* on the machine frame 10 in the area of the base 20 of the top end section. Furthermore, the side wall parts 90*a* and 90*b* are connected to one another by an axle 99, on which the cam follower 96 is rotatably mounted.

As a result, the counterforces acting on the feed bearing 70 during the forming are not introduced into the machine frame 10 by the lever gearing 82 in the area of the projection 22 of the top end section 18 but rather outside the projection 22, namely, on the one hand, into the base 20 of the top end section 18 by the pivot axis 88 and, on the other hand, into the column 16 itself by the axis of rotation 98 mounted relative to the column 16.

Figure 3:
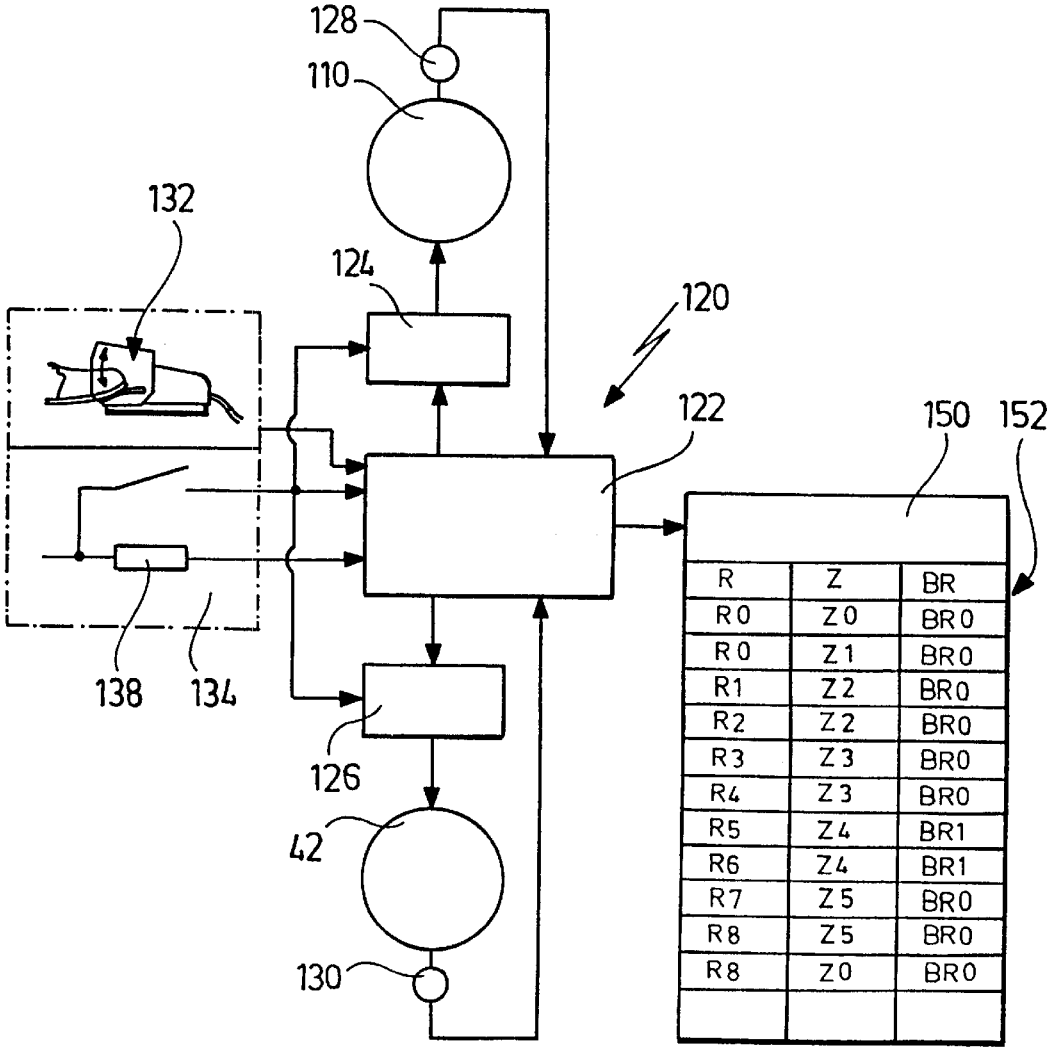
FIG. 3 shows a schematic illustration of an inventive control.

To operate the inventive sheet metal forming machine, a control designated as a whole as 120 is provided which, as illustrated in FIG. 3, has a central processor 122, with which, on the one hand, a regulator 124 for the feed drive 110 can be activated and, on the other hand, a regulator 126 for the roller drive 42.

Furthermore, a position indicating device 128 is associated with the feed drive 110 and a position indicating device 130 with the roller drive 42 and these devices can likewise be interrogated via the central processor 122.

Figure 4:
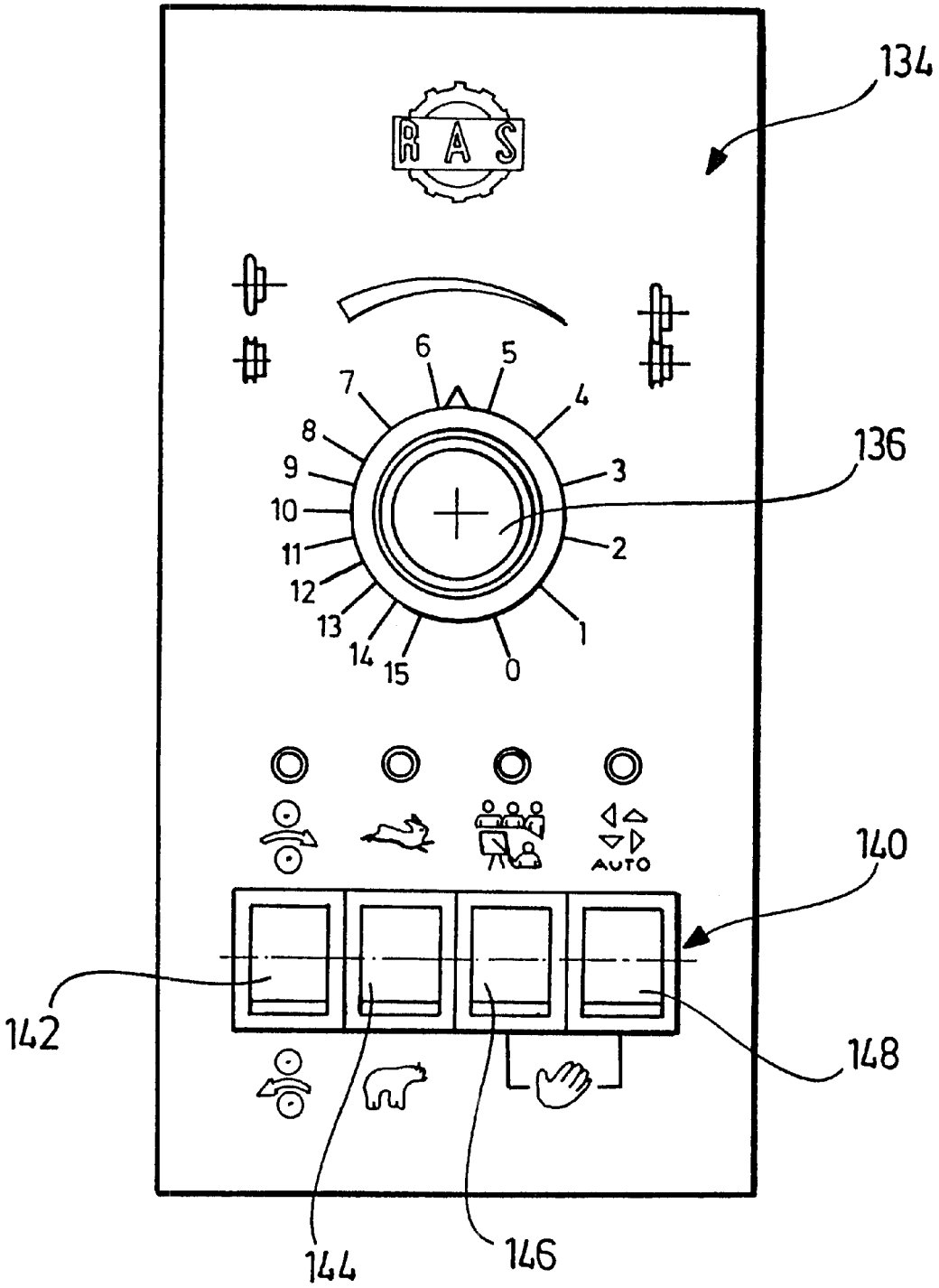
FIG. 4 shows an illustration of an operating panel for the inventive control and FIG. 5 shows a diagram which illustrates the allocation of feed positions to roller axis positions during the course of a forming cycle.

Furthermore, the desired speed for the roller movement, i.e. for the roller drive 42, can be specified to the central processor 122 via an external foot switch 132 and the feed position of the second roller tool 60 via a manual operating panel 134 illustrated, for example, in FIG. 4 by means of a transmitting device 138 manually adjustable via a control knob 136. Furthermore, a row of switches 140 is provided which comprises a switch 142 for switching over between two opposite directions of rotation of the roller drive 42, a switch 144 for switching over between high speed and low speed of the roller drive 42 and two switches 146 and 148 for switching over from manual operation to learning operation or from manual operation to operation of the feed positions controlled by the control 120, as will be explained in detail in the following.

Furthermore, a memory 150 is associated with the central processor 122, in which sets of data 152 can be stored, in which feed positions Z and information BR on the direction of movement of the roller axis movement are associated with individual roller axis positions R.

These individual sets of data are stored in the memory 150 by the central processor 122, for example, during the course of a learning mode which can be adjusted with the switch 146.

In such a learning mode, an exemplary workpiece 64 is machined in a forming cycle, wherein the individual roller axis positions are approached at a low speed by means of the foot switch 132 and the slow movement mode adjustable by means of the switch 144 and, in addition, the desired feed positions are adjusted manually with the transmitting device 138 so that the central processor 122 is in a position to record the roller axis positions and the feed positions, on the one hand, via the position indicating device 130 and the position indicating device 128 in addition to the information concerning the direction of movement of the roller axis movement and store this in the memory 150 as sets of data 152.

If all the sets of data 152 of the forming cycle for a workpiece 64 are stored in the memory 150, additional workpieces 64 to be machined in the same way can be processed in a forming mode controlled by the central processor 122, which can be switched on by the switch 148 and in which the desired speed of the roller axis movement can be specified to the central processor 122 via the foot switch 132.

In accordance with the roller axis positions which are thereby set, the central processor 122 can then determine the feed positions Z allocated to the respective roller axis positions R and the corresponding direction of movement BR in the memory 150 by means of the sets of data 152 so that the central processor 122 is in a position to activate the feed drive 110 such that the second roller tool 60 is in the corresponding roller axis positions R in the stored feed positions Z and, moreover, the roller drive 42 runs in the desired direction of movement BR.

Figure 5:
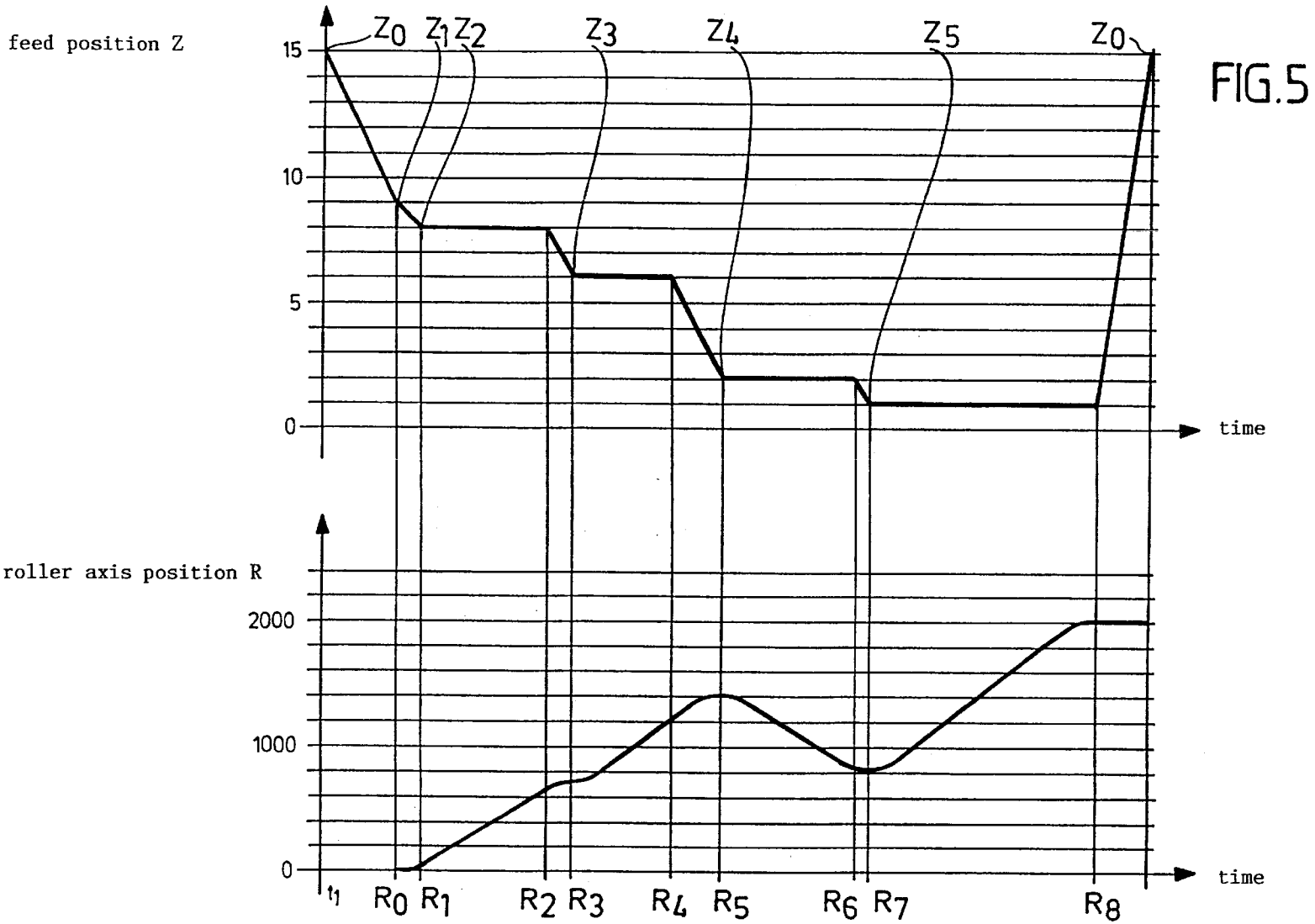

Such a forming cycle is illustrated, for example, in FIG. 5.

When the forming mode is switched on, the feed position Z1 associated with the roller axis position R0 is, for example, approached first of all by means of the central processor 122, proceeding from the feed position Z0, by advancing the second roller tool 60. Subsequently, the roller axis drive 42 is started by the central processor 122 and, at the same time, the feed drive 110 is activated so that at the roller axis position R1 the second roller tool 60 is in the feed position Z2. In this feed position, the roller axis drive 42 is operated further, as far as the roller axis position R2. Once the roller axis position R2 has been reached, an activation of the feed drive 110 starts again, namely such that when the roller axis position R3 is reached the feed position Z3 is reached. In this feed position Z3, the roller axis drive 42 is activated further, as far as a roller axis position R4 and once the roller axis position R4 has been reached the feed drive 110 is driven again, namely such that the feed position Z4 is reached at the point of time the roller axis position R5 is reached. In the roller axis position R5, a change in the direction of movement BR0 of the roller axis drive is brought about at the same time, controlled by the central processor 122, such that this drive moves in the reverse direction of movement BR1, namely until the roller axis position R6 is reached. Once the roller axis position R6 has been reached, a further activation of the feed drive 110 is brought about such that the feed position Z5 is reached when the roller axis position R7 is reached.

Once the roller axis position R7 has been reached, a reverse in the direction of movement BR1 in the direction of movement BR0 again takes place and, subsequently, the roller drive 42 is activated as far as a roller axis position R8. Once the roller axis position R8 has been reached, the roller axis drive 42 is stopped and an activation of the feed drive 110 is brought about such that the second roller tool 60 again transfers into the feed position Z0.

In order to ensure that the feed movement can follow despite the maximum speed of the roller axis movement predetermined by the foot switch 132 and in the respective roller axis position R the feed position Z associated with it is also reached, a speed limiting mode is provided in addition to the forming mode and this alters the speed of the roller axis movement so as to deviate from the maximum speed provided by the foot switch 132 when the central processor 122 recognizes, on account of the known adjusting times of the feed drive 110, that the feed positions Z stored in the sets of data 152 cannot be reached in the corresponding roller axis positions. In this speed limiting mode the central processor 122 reduces the speed of the roller drive 42 so such an extent that the speed of the feed movement can follow the individual roller axis positions and thus the allocation according to the sets of data 152 can be maintained.

For this purpose, the central processor 122 preferably processes the sets of data 152 in advance, i.e. when a specific roller axis position RX is reached sets of data 152, which correspond to future roller axis positions RX+Δ, have already been analyzed by the central processor 122 and so it can already be decided in advance whether a reduction in the speed of the roller drive 42 deviating from the maximum speed predetermined by the foot switch 132 is necessary in order to maintain the allocation of the feed positions Z to the roller axis positions R or in order to be in a position at a future roller axis position R to reverse the direction of movement which automatically requires a reduction in the speed of the roller axis movement to zero and subsequent acceleration.

In both cases, the speed limiting mode is preferably designed such that a limitation of the speed is brought about in accordance with a fixed value specified to the central processor 122.

It is, however, also possible to bring about the limitation of the speed as a function of the feed movements to be performed or alterations in the direction of movement.

What is claimed is:

1. Sheet metal forming machine comprising:

a machine frame, a first roller tool mounted on the machine frame for rotation about a first roller axis, a second roller tool rotatable about a second roller axis and interacting with the first roller tool, said second roller tool being mounted for rotation in a feed bearing, said feed bearing being for ito port movable and fixable in position in relation to the machine frame transversely to the first roller axis by means of a feed drive so that a feed position of the second roller tool relative to the first roller tool is adjustable, e-4 a roller drive for at least one of the roller axes, a feed detector for detecting said feed positions of said second roller tool, a roller axis detector for detecting roller axes positions of said roller axes, a control adapted to control said feed drive and said roller drive, a memory associated with said control, said control being operable in a learning mode in which said feed positions and said roller axes positions are adjusted manually by an operator acting on a first adjusting element for feed positions and a second adjusting element for roller axes positions in the course of actual performance of a forming cycle on a work piece, said control when operated in said learning mode recording said feed positions detected by said feed detector and said roller axes positions detected by said roller axes detector and storing said detected feed positions and said detected roller axes positions in said memory, said control being further operable in a forming mode in which said control by reading the stored data in said memory automatically controls said feed drive and said roller drive in accordance with said feed positions and said roller axes positions stored in said memory.

2. Sheet metal forming machine as defined in claim 1, wherein the control allocates feed positions to the roller axis positions and stores these in the memory as sets of data.

3. Sheet metal forming machine as defined in claim 2, wherein sets of data for at least one forming cycle of a workpiece are storable in the memory.

4. Sheet metal forming machine as defined in claim 1, wherein in the forming mode, the control, by reading the stored data, thereby automatically associates the stored allocation of the feed positions to the roller axis positions by activating the feed drive.

5. Sheet metal forming machine as defined in claim 4, wherein in the forming mode the maximum speed of the roller axis movement during the forming is manually predeterminable.

6. Sheet metal forming machine as defined in claim 1, wherein information concerning the roller axis movement is stored with the control.

7. Sheet metal forming machine as defined in claim 6, wherein the information concerning the roller axis movement is allocated to the roller axis positions.

8. Sheet metal forming machine as defined in claim 6, wherein the information concerning the roller axis movement is co-recorded in the sets of data comprising the roller axis positions and the feed positions.

9. Sheet metal forming machine as defined in claim 6, wherein the information concerning the roller axis movement is information concerning the direction of movement of the roller axis movement.

10. Sheet metal forming machine as defined in claim 6, wherein the control transfers into the speed limiting mode when a change in the direction of movement of the roller axis movement is intended to take place.

11. Sheet metal forming machine as defined in claim 1, wherein the control records the information associated with future roller axis positions proceeding from the current roller axis position.

12. Sheet metal forming machine as defined in claim 11, wherein the control transfers into the speed limiting mode on account of the information associated with future roller axis positions.

13. Sheet metal forming machine comprising:

a machine frame, a first roller tool mounted on the machine frame for rotation about a first roller axis, a second roller tool rotatable about a second roller axis and interacting with the first roller tool, said second roller tool being mounted for rotation in a feed bearing, said feed bearing being movable and fixable in position in relation to the machine frame transversely to the first roller axis by means of a feed drive so that a feed position of the second roller tool relative to the first roller tool is adjustable, a roller drive for at least one of the roller axes, a control adapted for controlling the feed drive as to its position, the second roller tool being movable by means of said drive into feed positions predeterminable in a defined manner, said control being adapted for controlling the roller drive and said control being further adapted to record said roller axis positions and said feed positions, said control being operable in a forming mode for controlled forming of a work piece, in said forming mode said control, by reading the stored data, automatically associates the stored allocation of the feed positions to the roller axes positions by activating the feed drive, the control having a speed limiting mode, the maximum possible speed of the roller axis movement being adjustable during said speed limiting mode with the control in the forming mode so as to deviate from the manually predeterminable speed of the roller axis movement.

14. Sheet metal forming machine as defined in claim 13, wherein the control transfers into the speed limiting mode when a feed movement is intended to be brought about.

15. Sheet metal forming machine as defined in claim 13, wherein the control in the speed limiting mode adapts the maximum possible speed of the roller axis movement to the maximum possible speed of the feed movement such that the association of feed position and roller axis position is maintained.

16. Sheet metal forming comprising:

a machine frame, a first roller tool mounted on the machine frame for rotation about a first roller axis, a second roller tool rotatable about a second roller axis and interacting with the first roller tool, said second roller tool being mounted for rotation in a feed bearing, said feed bearing being movable and fixable in position in relation to the machine frame transversely to the first roller axis by means of a feed drive so that a feed position of the second roller tool relative to the first roller tool is adjustable, a roller drive for at least one of the roller axes, a control adapted for controlling the feed drive as to its position, the second roller tool being movable by means of said drive into feed positions predeterminable in a defined manner, said control being adapted for controlling the roller drive and to store information concerning the roller axis movement, the control being adapted to transfer into a speed limiting mode when a change in the direction of movement of the roller axis movement is intended to take place, and the control in the speed limiting mode the speed of the roller axis movement to zero in accordance with a predetermined course during a change in the direction of movement of the roller axis movement and subsequently increases the speed again in the opposite direction in accordance with a predetermined course.

* * * * *

UNITED STATES PATENT AND TRADEMARK OFFICE

CERTIFICATE OF CORRECTION

PATENT NO. : 6,591,651 B2
DATED : July 15, 2003
INVENTOR(S) : Kutschker et al.

It is certified that error appears in the above-identified patent and that said Letters Patent is hereby corrected as shown below:

Column 10,
Line 60, delete the words “for its part”.
Line 66, delete “e-4” at the end of the line.

Column 12,
Line 59, after the word “mode” add -- reducing --.

Signed and Sealed this

Twenty-eighth Day of October, 2003

JAMES E. ROGAN
*Director of the United States Patent and Trademark Office*